United States Patent [19]

Boriskin et al.

[11] 4,273,298

[45] Jun. 16, 1981

[54] APPARATUS FOR CRUSHING AGGLOMERATED MASS

[76] Inventors: Ivan K. Boriskin, ulitsa Kutuzova, 10, kv. 29, Novokuznetsk; Jury S. Bragin, Chernogorsky bulvar, 9, kv. 18, Moscow; Mikhail S. Bykov, ulitsa Kirova, 3, kv. 38, Novokuznetsk; Valentin I. Gubanov, prospekt Metallurgov, 32, kv. 30, Novokuznetsk; Vladlen M. Ivanov, ulitsa Bardina, 36, kv. 164, Novokuznetsk; Eduard A. Tool, ulitsa Kirova, 50, kv. 62, Novokuznetsk, all of U.S.S.R.; Sergei V. Bazilevich, deceased, late of Moscow, U.S.S.R.; by Tatyana N. Bazilevich, administrator, ulitsa Kremenchugskaya, 9, kv. 53, Moscow, U.S.S.R.; Vitaly A. Sergeev, deceased, late of Novokuznetsk, U.S.S.R.; by Valentina I. Sergeeva, administrator; by Elena V. Sergeeva, administrator, both of ulitsa Tolyati, 23, kv. 12, Novokuznetsk, U.S.S.R.

[21] Appl. No.: 62,176

[22] Filed: Jul. 30, 1979

[51] Int. Cl.[3] ..... B02C 13/09

[52] U.S. Cl. ..... 241/189 R; 241/191

[58] Field of Search ..... 241/189 R, 190, 191, 241/195, 275

[56] References Cited

U.S. PATENT DOCUMENTS

| | | | |
|---|---|---|---|
| 2,618,438 | 11/1952 | Chrystal | 241/189 R X |
| 3,843,064 | 10/1974 | Suzuki | 241/190 X |
| 3,897,015 | 7/1975 | Suzuki | 241/190 X |

FOREIGN PATENT DOCUMENTS

| | | | |
|---|---|---|---|
| 2710077 | 9/1978 | Fed. Rep. of Germany | 241/189 R |

*Primary Examiner*—Howard N. Goldberg

*Attorney, Agent, or Firm*—Lackenbach, Lilling & Siegel

[57] ABSTRACT

The invention relates to mining and metallurgy. The apparatus comprises a feed device, and a discharging device and a rotor mounted inside a housing formed with toothed sprockets set rigidly on a shaft. The sprockets are mounted in series on the shaft of the rotor and carry crescent-shaped teeth, a concave surface thereof being arranged radially with respect to the rotor and the cross section being a T with a web located at right angle to the axis of said rotor and with a flange situated in parallel to the axis of said rotor. The invention can most advantageously be employed for crushing a hot agglomerated mass and stabilizing sinter lumps in terms of shape and mechanical strength, but may also be used to crush large coal lumps, slag skulls, particularly, ones in hot state, flagstone blocks, frozen materials and the like.

5 Claims, 5 Drawing Figures

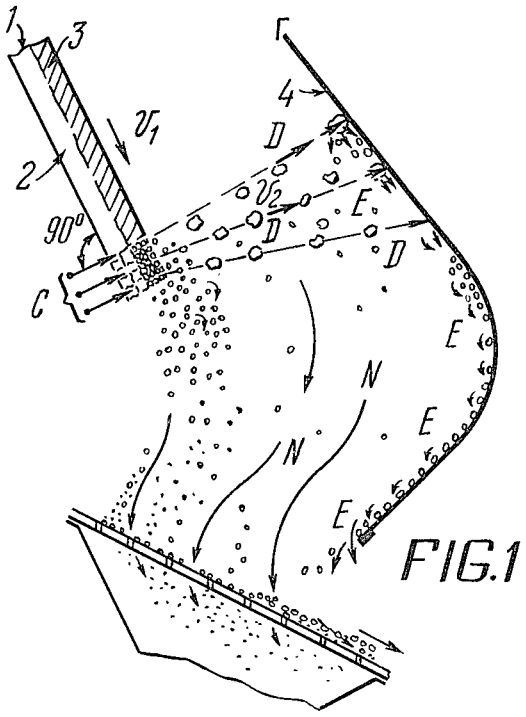
FIG.1
FIG.3
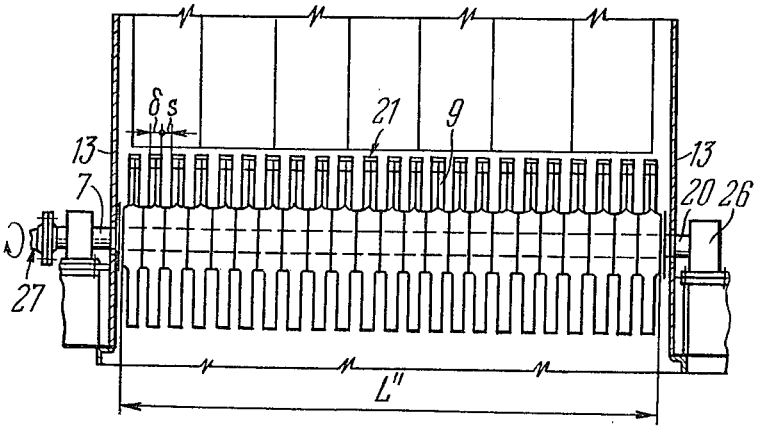

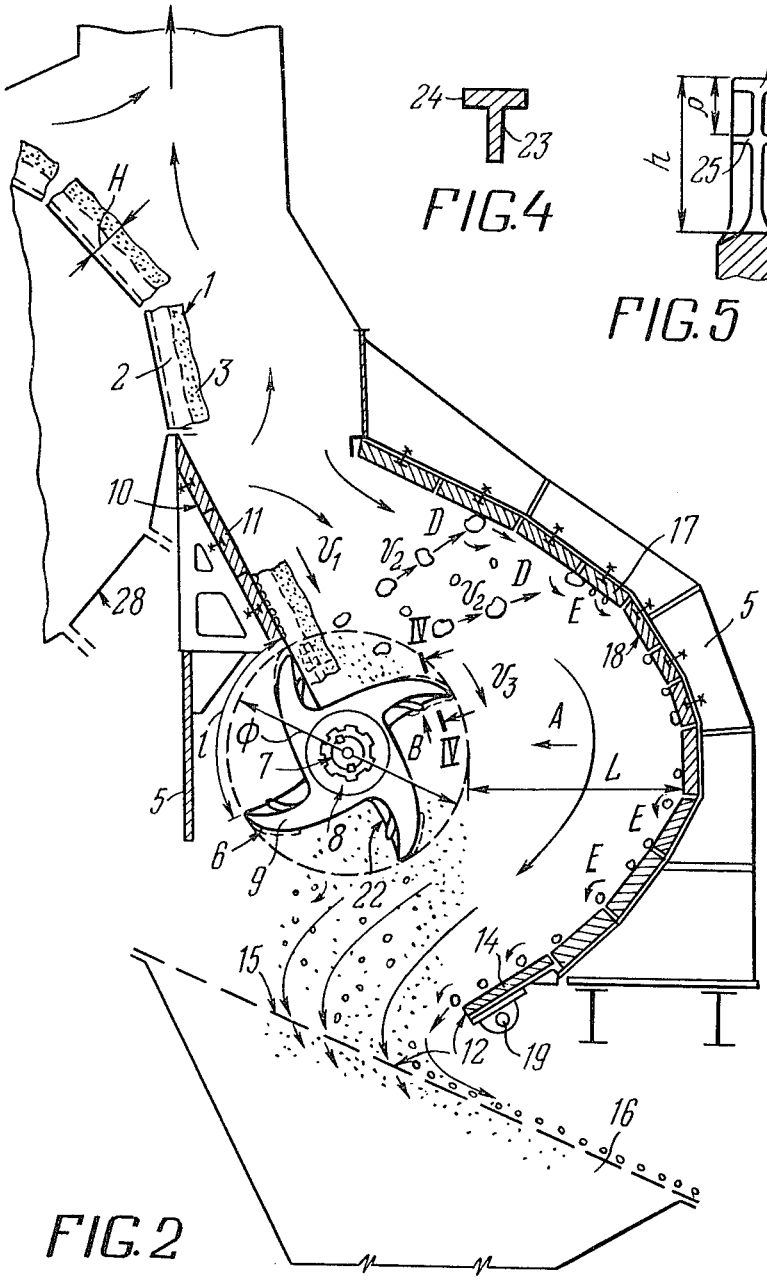
FIG. 2
FIG. 4
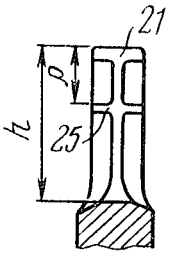
FIG. 5

APPARATUS FOR CRUSHING AGGLOMERATED MASS

BACKGROUND OF THE INVENTION

1. Field of the Invention

The invention relates to mining and metallurgy, and more particularly, to an apparatus for crushing agglomerated mass.

The invention can effectively be used for crushing hot agglomerated mass and stabilizing sinter lumps in terms of shape and mechanical strength.

The invention can also be employed for crushing large coal lumps, slag skulls (particularly when hot), flagstone blocks, frozen materials and the like.

The terminology used in the description is as follows.

Agglomerated mass is used to denote a sintered agglomeration burden comprising iron ore concentrate, sintered iron ore, limestone, solid fuel (such as coke fines, coal and the like) and other components. As the fuel burns, said components melt, then solidify turning into a strong agglomerated mass.

By sintered cake (agglomerated mass slab) we mean an agglomerated mass of a given geometric shape, as, for example, a rectangular slab.

Sinter is understood to be an agglomerated mass slab crushed to lumps of a specified size.

Standard sinter is understood to be a lump iron ore material obtained by crushing agglomerated mass and suitable, after fines (0 to 5 mm) are screened for blast-furnace smelting.

2. Description of the Prior Art

The performance of blast furnaces in terms of efficiency and specific coke consumption can be improved, all other conditions being equal, by providing an optimum size composition of burden materials, in particular, of sinter.

It is essential that a standard sinter charged into a blast furnace should be free from fines, i.e., particles less than 5 mm across, a preferable size of lumps for blast furnace smelting ranging from 5 to 40 mm, the optimum value being 10 to 20 mm across.

At present, most blast furnaces operate on lumps of iron ore materials measuring 100 mm on the high end of the size range and containing more than 10% of fines up to 5 mm in the standard product (sinter). A large proportion of fines results from the crushing of sinter when charged into skips, this amount being further increased through self-crushing and self-abrasion of lumps of sinter generally larger than 80 mm across as they descend in the blast furnace.

Existing methods and apparatus for obtaining sinter lumps of, for example, 50 mm on the high end of the size range generally embody two- or three-stage crushing and screening with a standard sinter yield of about 50%, fines up to 10 mm being removed by means of screens of various designs.

The main method for crushing an agglomerated mass slab is squeezing (pressing), the breaking action being obtained through a linear static compression of the sintered cake on its hot and cold sites simultaneously or through shear (cutting) or splitting of its individual sections effected with the aid of differently oriented shearing (splitting) forces applied to both cold and hot sides.

Crushing of the agglomerated mass according to the first method is performed with the aid of a jaw and two-roll crushers, and according to the second method, by means of toothed single-shaft crushers.

There is known a method for crushing agglomerated masses consisting in shearing (splitting) and squeezing (pressing) hot agglomerated mass slabs fed from charging devices into work zones of a crushing apparatus with the subsequent application of a constant force from a dynamically mobile system, acting substantially upon the cold side of the sintered cake, and of oppositely oriented static reaction forces, acting substantially upon the hot side of the cake, this resulting in crushing of the sintered cake.

The disadvantages of the above and other known methods of hot agglomerated mass crushing are a very slow build-up of dynamic forces in the process of crushing, prolonged contact of a sintered cake being crushed with work members of the crushing apparatus, absence of selectivity of crushing of agglomerated mass and no regulation whatsoever of the high end of the size range of sinter resulting from crushing of agglomerated mass.

There is known an apparatus for crushing agglomerated mass whose housing accommodates a rotor formed with toothed sprockets set rigidly on a shaft and having a feed and discharging devices.

The apparatus is provided with a bed carrying a bar screen.

A front wall of the apparatus housing accommodates a metal plate protecting it against abrasion.

The feed device is mounted in the top part of the bed and is intended to lift the sintered cake off the sintering pallets of a sintering machine and to feed it into the work zone of the apparatus.

The apparatus operates in the manner set forth below.

A hot sintered cake in the form of an agglomerated mass slab is lifted off a pallet to enter the space between the rotor and the bar screen, resting usually by its hot side upon the bars. The rotor, which revolves at a speed of 6 rpm, rolls by its toothed sprockets over the agglomerated mass slab, generally on the cold side, pushes the agglomerated mass between the bars, while squeezing the cold solidified part of the cake into the hot, still plastic, part thereof. The size of lumps pushed through the bars presents a great variety of length, width and thickness dimensions, as it is possible for a lump equal in thickness to a screen slot width and having much greater length and width dimensions to pass through the screen slots, this making the length and the width of the lumps uncontrollable. In addition, the pushing of the agglomerated mass slab through the screen gives rise to considerable friction forces between the agglomerated mass, the sprocket teeth and the screen bars, and results in an intensive wear of the grates.

The main disadvantages of said apparatus for crushing agglomerated mass are as follows:

operation of the grate and of the rotor under constantly severe thermal and physical conditions at temperatures of up to 900° C. of the hot agglomerated mass;

high abrasive properties of the cold agglomerated mass, which intensify the wear of any working members of the crusher; also there is a high degree of risk for the apparatus as a whole and for its separate elements to be damaged by any off-size stray metallic objects;

a low efficiency of the apparatus, as the sintered cake is broken up by the action of crushing (compressive) and shearing forces, this resulting in a low rate of crushing of the material by the sprocket teeth and the grates, since the rotor speed is low (not more than 6 rpm);

no selectivity in crushing of the sintered cake, as the operation is carried out through crushing of the sintered cake along a predetermined direction, this making it impossible to obtain a standard product with required (controllable) top dimensional limit of lumps by a single-stage crushing process, whereas the system formed with the screen bars and the rotating rotor sprocket is not designed to crush the agglomerated mass slab in three dimensions;

lack of intensive or even a partial extraction of heat from the sinter surface, as the hot agglomerated mass is not crushed to 30–40 mm, whereas the slow speed of the rotor (not more than 6 rpm) is inadequate to ensure a convective heat extraction and removal of heat from the hot sinter lumps. This, in turn, fails to provide a normal operation of sinter coolers, since the sinter lumps charged on the work surface of the coolers are far too large and have a very high internal temperature;

lack of means for enhancing the effectiveness of the screens, as it proves impossible to redistribute the crushed product over the work surface of the screens according to size classes; and lack of the stability of sinter lumps with regard to shape and mechanical strength, as the apparatus is not rated to provide adequate mechanical action upon the crushed product.

SUMMARY OF THE INVENTION

The principal object of this invention is to provide an apparatus for crushing agglomerated mass which would make it possible to obtain a blast-furnace sinter of optimum size composition by a single-stage crushing process.

Another object of the present invention is to provide apparatus which would make it possible to obtain a blast-furnace sinter of stable shape and mechanical strength by a single-stage crushing process.

The apparatus for agglomerated mass crushing, effected on the hot side thereof, makes possible a selective crushing against a least consumption of electric power per ton of standard product (sinter). Impacts applied to the hot side prevent an over-crushing of the sinter through compression of the cold solidified mass of the sintered cake and make it possible to concentrate the impact loads upon the strongest, most elastic and partly plastic portion of the sintered cake.

The above and other objects are attained in an apparatus comprising a housing accommodating a rotor formed with toothed sprockets set rigidly on a shaft, a feed device and a discharging device. The toothed sprockets are set in series on the rotor shaft, the teeth having a crescent shape with the extreme points of the concave surface being located radially with respect to the rotor, and the teeth having a tee cross section with the web thereof, arranged at a right angle to the axis of the rotor, and with the flange thereof disposed parallel to the axis of the rotor.

The series arrangement of the toothed sprockets, set on a single line parallel to the axis of the rotor, makes it possible to effect simultaneously a splitting blow by a group of teeth upon a section of an agglomerated mass slab which has entered the work zone of the rotor. This ensures a translational, directional, ordered motion of the slab, preventing random falling of lumps and enabling blows to be applied by a most active part of the teeth, i.e., by their work edges. The crescent shape of the tooth, with the apex thereof having a minimum surface area for support, provides for an unhindered discharge of an agglomerated mass slab as a section of the slab, which has entered the work zone of the rotor, and which is sheared therefrom as the tooth apex cuts through the body of the slab. The crescent shape of the teeth providing a maximum concentration of impact loads at points where the blows are applied. This prevents practically a non-central application of the load by a tooth upon the agglomerated mass slab and a random projection of the turning non-crushed lumps of the mass from the work zone of the rotor, thereby improving the crushing effect in terms of breakage of the whole of the agglomerated mass slab against a minimum of electric power consumption.

In addition, the concave surface of the teeth allows for a more effective concentration of the impact load in terms of time, whereas its work surface arranged radially with respect to the axis of the rotor and at the edges ensures the application of an impact approximating substantially a normal blow, this enhancing the concentration of the impact loads and providing a greater crushing efficiency.

An enlarged base makes the crescent-shaped teeth very strong mechanically.

The most advantageous height of the sprocket teeth from the viewpoint of sintered cake crushing effectiveness is one where the ratio of tooth height to maximum thickness of the sintered cake is (1 to 1.5):1, i.e., one which ensures a complete cutting of the sintered cake by the sprocket teeth.

Transversely, the teeth have a tee (T) cross section with a web which is arranged at right angle to the axis of the rotor and fulfills initially the function of a stress concentrator—a splitter—as a blow is applied. The tee web also splits the strong incandescent part of the sintered cake into large lumps and initiates an impact wave which ensures a selective breakage along the weakened inter-block sections of the solidified part of the agglomerated mass slab and prevents the penetration of the cold, more solid mass into a hot, less solid plastic mass. This enhances the effectiveness of crushing from the viewpoint of agglomerated mass slab breakage and optimum size composition of the standard sinter.

The tee flange makes possible the gripping of large incandescent agglomerated mass lumps (resulting from initial brakage) whose size exceeds the dimensions of the slot formed between the teeth of adjacent sprockets in a single row and imparting to said lumps sufficient kinetic energy for subsequent final crushing and stabilization of the size and of the mechanical properties of the sinter lumps.

This ensures, in the final analysis, the production of sinter lumps of a specified top size limit and of maximum mechanical strength, which is due to the fact that the teeth of the rotor rotating at a high speed (up to 420 rpm) in the direction of sinter lump motion create a directional flow of air which intensifies the extraction of heat from the surface of incandescent sinter lumps and thus promotes the solidification of the non-solidified agglomerated mass slab and the formation of a stronger iron oxide structure in the form of a dendrite framework.

It is advantageous to secure to the tee section web at least one stiffening rib, this providing, for the same dynamic impact value, a lesser top size limit, i.e., a greater effectiveness of agglomerated mass slab crushing.

It is good practice to locate a shield, having a curvilinear surface, inside the apparatus housing at a distance from the rotor generatrix which is substantially equal to the rotor diameter.

The shield of this type construction contributes to further crushing of larger agglomerated mass lumps and stabilizes effectively their size as various projections and weak formations on the lumps are knocked off while the lumps roll over the curvilinear surface of the shield. This, in the final analysis, results in all of the standard product (sinter) having a specified top limit size and in a maximum stabilization of sinter size composition.

Roughly 50 to 25% of all the standard product are broken to final size on the shield, it being more advantageous to handle a hotter, thoughout its height, sintered cake.

The size of the gap between the rotor generatrix and the shield along the horizontal axis is such as to prevent the wedging of sintered cake lumps when the rotor stops and to utilize more effectively the kinetic energy of the lumps which are projected by the teeth flanges upon the guard shield.

Lump size is stabilized more effectively if the curvilinear surface of the shield is shaped as a parabola, with its apex located level with the axis of the rotor and has a length sufficient to ensure a maximum stabilization of sinter lump size.

The proposed construction is highly reliable and safe in operation; it is readily adapted for automatic performance in sinter production, being not larger in size than the existing sinter crushing plants; also, it is easy to service and replace; requires minimum consumption of electric power per ton of standard sinter and minimal capital investments; its throughput capacity is many times greater than that of a sintering machine on which it may be mounted.

BRIEF DESCRIPTION OF THE DRAWINGS

These and other objects and features of the invention become readily apparent from one embodiment thereof which will now be described, by way of example, with reference to the accompanying drawings, in which:

FIG. 1 illustrates schematically successive steps in the breakage of an agglomerated mass slab until lumps of optimum size for blast furnace smelting are obtained;

FIG. 2 is a schematic cross section of an apparatus for crushing agglomerated mass;

FIG. 3 is a schematic longitudinal section of a crushing chamber, view along arrow A on FIG. 2, of an apparatus for crushing agglomerated mass, according to the invention;

FIG. 4 is a cross sectional view along the line IV—IV of FIG. 2 showing a section of a rotor sprocket tooth; and FIG. 5 is a schematic view along the arrow B on FIG. 2 of web of tee with a stiffening rib.

DESCRIPTION OF THE PREFERRED EMBODIMENT

The method of crushing agglomerated mass is illustrated in FIG. 1 and is characterized by agglomerated mass crushed through the agency of a dynamic impact directed along arrow C upon a slab 1 of agglomerated mass moving at a velocity $V_1$. The slab 1 of agglomerated mass has a hot side 2 and a cold side 3. The dynamic impact along arrow C is effected at an angle of 90° to the surface of the slab 1 upon its hot side 2.

The force of the impact is concentrated in the hot side, the strongest plastic part of the agglomerated mass, then a portion of the impact energy effects a direct mechanical breakage of the hot side 2 of the slab 1 of the agglomerated mass into a pattern of glass breakage, while another part of the impact energy in the form of an impact wave (which spreads the same as in an elastic medium at a speed of more than 2000 m/sec) breaks the solidified (cold) portion of the agglomerated mass along the weakest inter-block cross sections and areas, leaving unbroken only the strongest sinter lumps which are crushed subsequently. This is the procedure for selective crushing of agglomerated mass.

However, the largest broken lumps of hot plastic agglomerated mass, which have not been broken to optimum size and which have acquired a sufficient amount of kinetic energy, move in directions along arrows D at a velocity $V_2$, and impinge for a second time upon a solid obstacle 4 (guard shield) at an angle less than 90°, break up to a specified size and, having acquired a rotary motion, roll in directions along arrows E over the curvilinear concave smooth surface of the solid obstacle 4, the result being stabilized as to both shape and mechanical properties of the sinter lumps.

With a view of improving the quality (crushing to constant size the time) of crushing, the slab 1 of the agglomerated mass is fed at a constant specified velocity $V_1$ and directed strictly along the motion of the sintered cake so as to prevent a disordered fall of the slab 1 into the crushing zone.

It thus proves possible, as a result of the dynamic impact on the hot side 2 of the agglomerated mass, selective crushing of the agglomerated mass, and the elimination of the overcrushing of the cold agglomerated mass through mechanical squeezing and mixing with hot plastic sintered cake, to obtain a standard product of optimum, with respect to blast-furnace smelting, requirements, top limit size and size composition.

There is proposed an apparatus for crushing agglomerated mass illustrated in FIG. 2.

The apparatus comprises a housing 5 which accommodates a rotor 6 formed with sprockets 8 with teeth 9, the sprockets 8 being set rigidly on a shaft 7 of the rotor 6.

The apparatus also comprises a feed device and a discharging device. The feed device is basically a chute 10 with a working surface 11 of wear plates, which is set radially with respect to the shaft 7 of the rotor 6.

The housing 5 of the apparatus is a metal construction welded of sheet and sections and made air-tight in the zone surrounding the rotor 6.

The discharging device is basically an outlet hole 12 formed with side 13 (FIG. 3) and a front wall 14 of the housing 5 and defined at the underside by a work surface 15 of a device 16 for screening crushed sinter.

The apparatus has a guard shield 17, previously termed as a solid obstacle 4, of curvilinear shape approximating a parabola with the apex thereof lying level with the axis of the rotor 6, the guard shield being of a wear-resistant material. The internal concave smooth surface 18 of the shield 17 goes around the rotor 6 by an angle ensuring reception and discharge of sinter lumps in the work zone of the rotor 6 and ensuring their maximum size stabilization. The shield 17 is a welded metal construction lined on the inside with wear plates and secured to the housing 5 with the aid of a hinge 19 so that its position can be adjusted in space as required. The inside surface 18 of the shield 17 is set along the horizontal axis 20 (FIG. 3) of the rotor 6 at a distance L (FIG. 2) from the generatrix of the rotor 6 substantially equal to diameter $\phi$ of the rotor 6. The distance L is a function of a maximum utilization of the kinetic energy of the lumps as they impinge upon the guard shield 17 and should additionally be such as to prevent wedging of agglomerated mass lumps in any emergency stoppages of the apparatus.

According to the invention, the sprockets 8 with teeth 9 are set on the internally water-cooled shaft 7 of the rotor 6 in series and in such a manner as to locate work edges 21 (FIG. 3) of the teeth 9 of a single row along a same line parallel to the axis 20 of the rotor 6, whereas the length of arc l (FIG. 2) of the gripping sector (distance between edges of adjacent teeth in the sprocket) should be governed by the ratio of the inlet velocity $V_1$ of the slab 1 of the agglomerated mass into the work zone of the rotor 6 to the optimum peripheral velocity $V_3$ of rotation of the teeth 9 of the rotor 6, its value being substantially equal to 1:5.

The teeth 9 are crescent shaped, their forward concave surfaces 22 being located radially with respect to the rotor 6. The teeth 9 are, in cross section, a tee, such as shown in FIG. 4, with a web 23 arranged at right angle to the axis of the rotor 6, and with a flange 24 positioned in parallel to the axis 20 of the rotor 6. The tee has a cross section variable with the height and a variable height of the web 23.

To provide a maximum load at the point of impact where the tooth 9 bears by its end face (front) the web 22 of the tee, it is imperative to stagger in time the penetration of said web 22 into the slab 1.

The crescent shape of the tooth 9 is the one which provides for a minimum contact area when the work edge 21 of a tooth 9 cuts through a given section of the agglomerated mass slab 1 and so avoids the slowing down of said slab 1 as it bears upon the edge 21 of the tooth 9. In addition, the subsequent motion of the tooth 9 through the body of the slab 1 should tend to lower its work edge 21 in the direction of motion of the slab 1, at least by a value equal to its descent during the time it takes for the tooth 9 to cut through the slab 1, i.e. by a ratio of more than 1:1. In this case, there will occur no shift of the agglomerated mass along the work edge 21 of the tooth 9 if the angle of contact of the tooth 9 with the surface of the agglomerated mass slab 1 approximates 90°, this substantially lessening the abrasive action of the agglomerated mass upon the material of the tooth.

In addition, the contact of the work areas of the tooth 9 and of the surface 18 of the shield 17 with plastic hot agglomerated mass lumps sharply reduces abrasive action thereon, hence is a high wear-resistance of work members of the proposed apparatus for crushing agglomerated mass.

The web 20 of the tee of the tooth 9 may be with or without stiffening ribs, such as shown in FIG. 5. Such construction ensures a more effective crushing of the agglomerated mass, all other things being equal, and yields a lesser top limit size of lumps, as a section of sintered cake sheared on initial contact with the edge 21 of the tooth 9 is then split additionally by a "false" edge 25 (FIG. 5) provided in the work zone of the tooth 9 at a distance $\rho$ from the edge 21.

The height h of the tooth 9 is substantially equal to (1 to 1.5):1 times the thickness H of the sintered cake. The distance S (FIG. 3) between the edges 21 of the flanges 24 of the teeth 9 of the adjacent sprockets 8 must be substantially equal to the specified top limit size of the sinter lumps, whereas the thickness $\delta$ (FIG. 3) of the tooth 9 of the sprocket 8 should be substantially equal to S, but it is also correlated with the structural strength of the tooth 9.

Bearings 26 of the rotor 6 should be designed for service in dust-laden atmosphere at $t \approx 150°$ C.

It is very convenient to have an electric drive 27 operating on direct current in order to make possible a smooth adjustment of rotor speed as a function of sintering techniques.

It should also be recognized that the letter L″ in FIG. 3 designates the working part of the rotor that ensures complete seizure of the sintered cake over the whole width of the pallet by means of the rotor sprockets, and that the letters E in FIGS. 1 and 2 represent rotational motion of the crushed lumps or product pieces along the curved linear surface of the shield.

OPERATION

Agglomerated mass in the form of a slab 1, having hot 2 and cold 3 sides, slides off the sintering pallet 28 (FIG. 2) of the sintering machine, rolls freely over the work surface 11 of the chute 10 of the feed device to enter the work zone of the rotor 6 rotating in the direction of motion of the slab 1 of the agglomerated mass at a specified speed. The teeth 9 of the sprockets 8 of the rotor 6 impinge at right angle on the hot side 2 of the slab 1 of the agglomerated mass, shearing by the work edge 21 of the tooth 9 a section of agglomerated mass along the length of the slab 1 and splitting said section into separate large lumps in the direction of motion of the agglomerated mass. Fine crushed, mainly cold, sinter falls through the gaps between the teeth 9 of the adjacent sprockets 8 upon the work surface 15 of the device 16 for screening sinter, whereas the larger lumps, which have not been broken up to top limit size, mainly of hot agglomerated mass, are gripped by the flanges 24 of the tee of the tooth 9 which then project said lumps against the guard shield 17.

Having acquired a sufficient amount of kinetic energy, the lumps move through inertia, attach the surface 18 of the shield 17 at an angle of not less than 90° and break up into lumps with a top limit size close to a specified value. As a result of the tangential motion along a curvilinear surface, broken sinter lumps are given a rotary motion and tumbled. All the projections and weak formations are broken off, the surface of the lumps are strengthened, acquiring a round shape on rolling through a predetermined length of path along the surface 18 of the shield 17, and the lumps are stabilized in the process.

Both the rotor 6 rotating at a speed of more than 20 m/s and the shield 17 create a considerable air flow directed along arrows N (FIG. 1) toward the screening device 16. The fully open blocks (most dense lumps) of sinter are intensively cooled, this being particularly true of the sinter lumps broken up to the optimum size. Due to a rapid solidification of the remaining part of the melt, dendrites of iron oxide form in the center (core) of the sinter lumps and strengthen them.

Thus, sinter lumps, subjected to an impact crushing (2 impacts), stabilized in shape and mechanical strength and partly cooled, are then screened and further treated.

Therefore a one-stage impact crushing and stabilization of the apparatus yields a sinter of optimum (for blast furnace smelting) size composition, of most suitable shape for interaction with gases and of high mechanical properties, which, in terms of abrasion resistance and of impact strength, surpasses by respectively 2–3 times (in abs. %) and 10% those of sinter treated in known apparatus.

The efficiency of the apparatus of the invention exceeds that of sintering machines by a factor of more than 6, and the yield of standard sinter being equal to or greater than that of existing two or three-step sinter crushing methods and apparatuses.

While the invention has been described in terms of the preferred embodiment, numerous modifications and variations may be made in the apparatus illustrated and shown in the drawings and described in this specification without departing from the invention as set forth in the appended claims.

What is claimed is:

1. An apparatus for crushing agglomerated mass comprising: a housing having an outlet; a feed device including a chute for feeding said agglomerated mass into said housing; a rotatable rotor juxtaposed beneath said chute, having a shaft and formed with sprockets, and being located in said housing; said sprockets of said rotor being rigidly set in series on said shaft; said sprockets having crescent-shaped teeth with a work edge and with a concave surface thereof being arranged radially with respect to said rotor and having a T-shaped cross section with a web thereof arranged at a right angle to the axis of said rotor and a flange thereof arranged in parallel to the axis of said rotor, so that said agglomerated mass is struck by the work edge of said teeth as said rotor rotates into the path of the agglomerated mass being fed into said housing via said chute.

2. An apparatus for crushing agglomerated mass as claimed in claim 1, wherein the height of said tooth is in a ratio substantially equal to 1 to 1.5:1 relative to the thickness of said agglomerated mass being crushed.

3. An apparatus for crushing agglomerated mass as claimed in claim 1, wherein said web has at least one stiffening rib parallel to said flange.

4. An apparatus for crushing agglomerated mass as claimed in claim 1, wherein the housing accommodates a guard shield with a curvilinear surface surrounding said rotor, and said curvilinear surface being located at a distance from the generatrix of said rotor which is substantially equal to the diameter of said rotor, whereby further crushing of coarser pieces of said agglomerated masses is achieved as said coarser pieces tumble along said curvilinear surface to said outlet.

5. An apparatus as claimed in claim 4, wherein the curvilinear surface of the guard shield is shaped as a parabola with the apex thereof located on the axis of said rotor.

* * * * *